United States Patent [19]

Davitz

[11] 4,217,853

[45] Aug. 19, 1980

[54] HANGING RACK FOR FINISHING SYSTEM

[75] Inventor: Walter E. Davitz, Columbus, Ohio

[73] Assignee: Production Plus Corporation, Columbus, Ohio

[21] Appl. No.: 28,277

[22] Filed: Apr. 9, 1979

[51] Int. Cl.[2] ..... B05C 13/02

[52] U.S. Cl. ..... 118/500; 204/297 W; 211/119

[58] Field of Search ..... 118/50 P; 204/297 W; 211/119, 113, 117, 124; 248/221.3

[56] References Cited

U.S. PATENT DOCUMENTS

| | | | |
|---|---|---|---|
| 4,037,727 | 7/1977 | Kunkle | 204/297 W X |
| 4,097,359 | 6/1978 | Davitz | 118/500 X |

FOREIGN PATENT DOCUMENTS

| | | | |
|---|---|---|---|
| 2308706 | 11/1976 | France | 204/297 W |

*Primary Examiner*—John P. McIntosh
*Attorney, Agent, or Firm*—Frank H. Foster

[57] ABSTRACT

A support rack or gang hanger on which workpieces are mounted for transporting the workpieces past an electrostatic spray coating station. The rack has an electrically conductive main frame and removable workpiece support hooks which are mechanically and electrically connected to horizontal, shielding crossbars of the main frame. Each shielding crossbar is a downwardly opening channel member which has a plurality of crossbeams extending between the legs of the channel member. These crossbeams are spaced along the length of the channel member and spaced from the cross web of the channel member. A plurality of such channel members are welded at their ends to vertical sidebars in vertically stacked arrangement.

A plurality of support hooks, each having a workpiece engaging portion and a crossbar engaging portion extend upwardly into the channel members. The support hooks are bent metal rods each of which extends into engagement with and partially around a different one of the crossbeams between its associated crossbeam and the cross web of the channel member and then extends further into engagement against the cross web. The crossbar engaging portion of each support hook is resiliently flexible and applies oppositely directed resilient forces against the cross web and its associated crossbeam for releasably retaining the hooks in the crossbar under spring tension and conductive contact.

10 Claims, 9 Drawing Figures

HANGING RACK FOR FINISHING SYSTEM

TECHNICAL FIELD

This invention relates to gang hangers or hook racks which are fabricated of metal and used for supporting many individual workpieces as they are conveyed through a finishing system for cleaning, preparing and coating the workpieces. More particularly this invention relates to electrically conductive support racks with easily removable support hooks for use in the electrostatic spray coating of liquid or dry charged particles onto workpieces at a coating station such as a paint spray booth.

BACKGROUND ART

Support racks of this type are usually provided with several, vertically stacked, horizontal rows or tiers of protruding, article-engaging hooks upon which workers hang parts to be finished. The article engaging portion of the hooks may be constructed in a variety of shapes. Ordinarily each hook is simply a piece of wire having its article-engaging end bent into a hook shape. The term hook is utilized, however, to include the great variety of configurations which may be devised for engaging workpieces.

Conventionally, support racks are suspended from a conveyer and a large number of parts are connected to the hooks of the rack. The rack and its suspended workpieces travel through a finishing system having a series of stations at which they may be sequentially treated by one or more of the steps of cleaning, rinsing, surface preparation such as undercoating, rinsing again, drying, coating and baking. Usually finishing includes travel through a spray booth where the workpieces are sprayed and coated with a conventional material. They may thereafter advance through a baking oven in which the applied coating is heat treated, hardened and dried.

Workers then remove the finished parts and reuse the racks. However, because the racks are constantly recycled through the finishing system, they become encrusted with multiple layers of the coating material.

In electrostatic painting, the coating particles are electrically charged and directed toward a suspended workpiece. The workpiece is electrically connected to the ground potential through the conductive support rack so that the coating material is attracted by an electric field to the suspended parts. It is extremely important that the electrical contact between each support hook and the main frame of the support rack be maintained as a good, low resistance electrical contact so that the suspended parts will remain well grounded. The accumulation of nonconductive or high resistance coating particles at the interfacing surfaces between each hook and the main frame of the rack must be prevented.

If the coating material is applied to these contacting, interfacing surfaces, it will create a high resistance in the circuit from ground to the part which will inhibit electrical current flow. The current flow is necessary in order to supply electrons for neutralizing the charge of the coating particles after they are deposited on the suspended parts so that subsequently arriving, positively charged particles will be uniformily attracted to the workpieces. The undesirable resistance would ultimately result in a buildup of electrical charge in the area of the parts being painted upon the support racks. The buildup of charge would reduce the attraction of the part to the coating material and would also create a potential spark hazard caused by an arcing discharge which could ignite an explosion or fire.

A single painting or coating operation applies a coating layer to the exposed, article-engaging portion of the support hooks. This layer usually entirely covers the hooks except for the small area of direct contact with the part. Often a hook can be reused for an identical part which will be in electrical contact with the hook at the identical place. However, for a part which is positioned differently on the hook even one layer of coating material reduces electrical contact of the hooks with the workpieces.

It is therefore desirable that the hooks of the support rack be detachably engaged to the main frame of the rack so that the hooks may be periodically removed, cleaned and replaced. Alternatively, they may be removed and replaced with new hooks or with ones of a different shape to accomodate different parts.

One workpiece supporting rack which is shown in the prior art is described in U.S. Pat. No. 4,097,359 and the patents referred to therein. Still another work holder is shown in U.S. Pat. No. 2,904,492.

A major difficulty with the prior art racks is the difficulty of removing the hooks from the main frame of the rack. Another disadvantage is that the prior art racks are more expensive to construct because they require more metal and more manufacturing operations than the rack of the present invention. Because of the manner that the hooks are attached to the main frame of prior art racks, they have a further disadvantage that the wire size used for the hooks of a particular prior art rack is narrowly limited to the particular wire size for which the rack was designed.

It is therefore an object of the present invention to provide a versatile finishing support rack which has hooks which are removable or replaceable with a minimum of human manipulation and with hooks of a broad range of wire sizes and yet provides a finishing support rack which is of a stronger and sturdier construction and easier to fabricate than prior art racks and still provides complete shielding of the electrical contacts between the hooks and the main frame of the support rack.

BRIEF DISCLOSURE OF THE INVENTION

The present invention has a shielding crossbar, such as a narrow, inverted, U-shaped, channel member with opposed, spaced panels, a cross web extending between and longitudinally along the panels and at least one crossbeam and preferably several crossbeams extending between the panel and spaced from the cross web. Preferably the crossbeams are spaced longitudinally along the crossbar. A support hook having a workpiece engaging portion and a crossbar engaging portion extends upwardly between the spaced panels into engagement with and partially around the crossbeam and further extends into engagement against the cross web. The crossbar engaging portion of the support hook is resiliently flexible and applies oppositely directed resilient forces against the cross web and against the crossbeam for releasably retaining the hook in the crossbar.

DESCRIPTION OF THE PREFERRED EMBODIMENT

Figure 1:
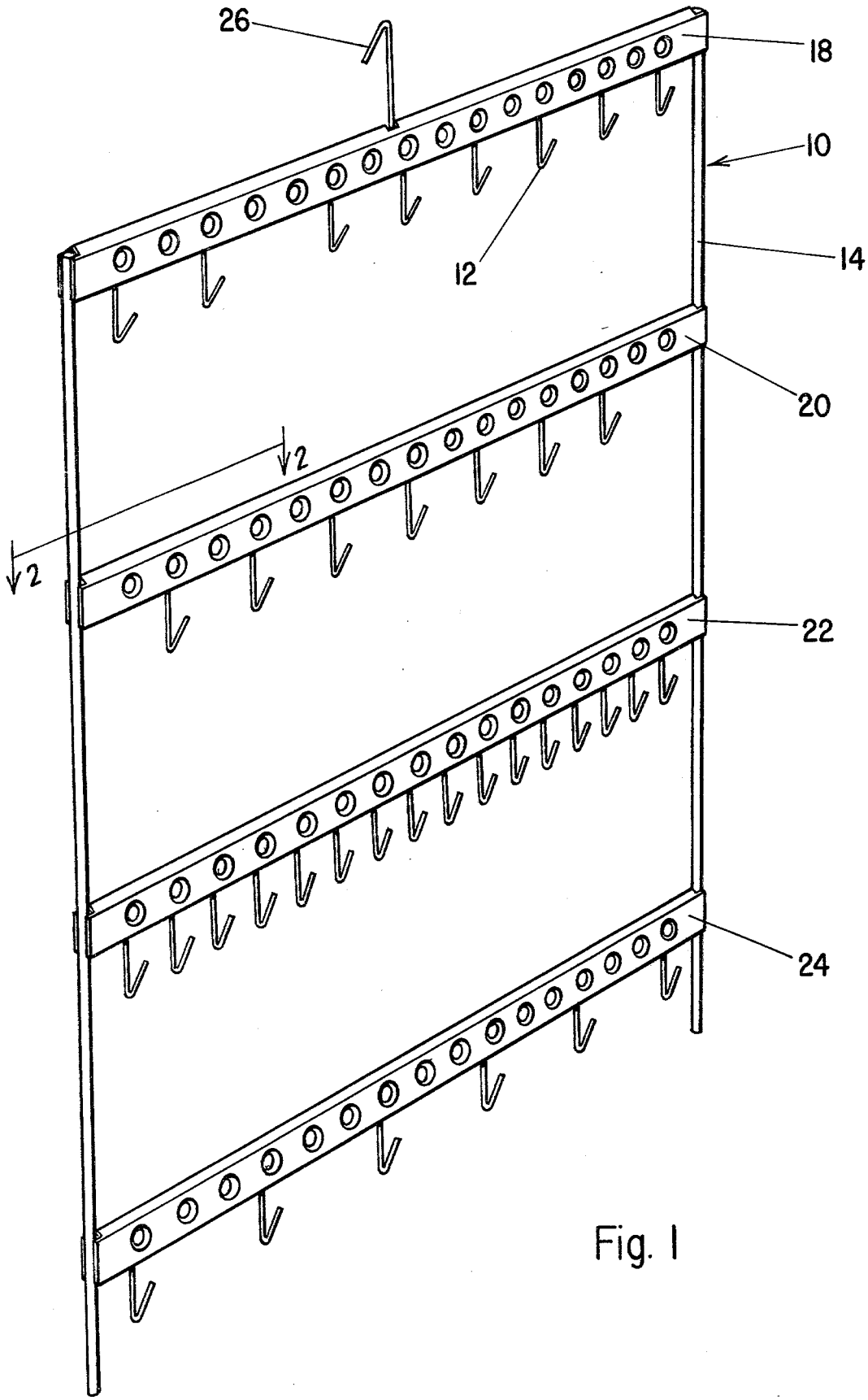
FIG. 1 is a view in perspective of an entire finishing support rack embodying the present invention.
Figure 2:
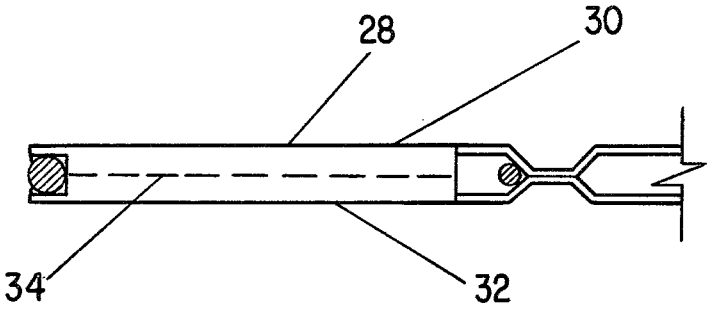
FIG. 2 is a top view of an end portion of the shielding crossbar of the present invention with a section removed along the lines 2—2 of FIG. 3.

A rack embodying the present invention is illustrated in FIG. 1 and comprises a main frame 10 and removable workpiece support hooks, such as hook 12, on which workpieces are hung for transporting the workpieces through a finishing system. The main frame of the present invention includes a pair of vertical sidebars 14 and 16, four generally horizontal shielding crossbars 18, 20, 22 and 24 and a top hook 26. All the parts of the main frame 10 are metallic and are welded together for rigid mechanical connection and low resistance electrical connection so that there is complete electrical conduction throughout the main frame.

Referring now to FIGS. 2–5, the preferred shielding crossbars, such as crossbar 20, each comprises a horizontal, downwardly opening, U-shaped channel member 28. The channel member 28 includes a pair of spaced panel or legs 30 and 32 which are connected by a crossweb 34 at the top of the crossbar and longitudinally along the panels or legs 30 and 32. A plurality of crossbeams, such as crossbeams 36, 38 and 40 are connected between the panels or legs 30 and 32. These crossbeams are arranged longitudinally along the channel member 28. They are spaced from each other and spaced below the cross web 34 of the channel member 28.

While the crossbeams could be made of a variety of structures, such as bolts or rods welded in opposite holes, we prefer to form these crossbeams from a pair of opposite, inwardly tapering, frusto-conical projections or bosses which are embossed into the legs of the channel members. These bosses or projections are connected together, for example by spot welding or metal stitching, to form an annular, bevelled groove, such as groove 41, in the crossbeams.

The attachment of the bosses not only prevents the separation of these bosses when the hooks are connected to them and loaded down with workpieces, as described below, but also improves the rigidity and strength of the crossbars so that they resist deflection from the weight of the workpieces hung upon the hooks.

Typically, sixteen such crossbeams are formed on each crossbar. However, they may be formed at any desired spacing or irregular spacing and in any desired numbers. For example, there may be different spacings in a single rack for accomodating the painting of different but similarly colored parts of a single assembly.

Each crossbar may be formed from a single, flat sheet which is embossed with the frusto-conical projections and then bent around into the U-shaped configuration. In so doing, it is preferred that the cross web of the channel member be formed to taper inwardly and upwardly to form an interior bevelled groove. As described below, this interior bevelled groove, such as groove 42, along with the annular bevelled grooves, such as groove 41, which are formed around the crossbeams, provide receiving seats for the crossbar engaging portion of the support hooks. These grooves retain the support hooks in the center of the channel member 28 and restrain them from lateral movement or side play toward the panels or legs of the U-shaped crossbars.

Figure 3:
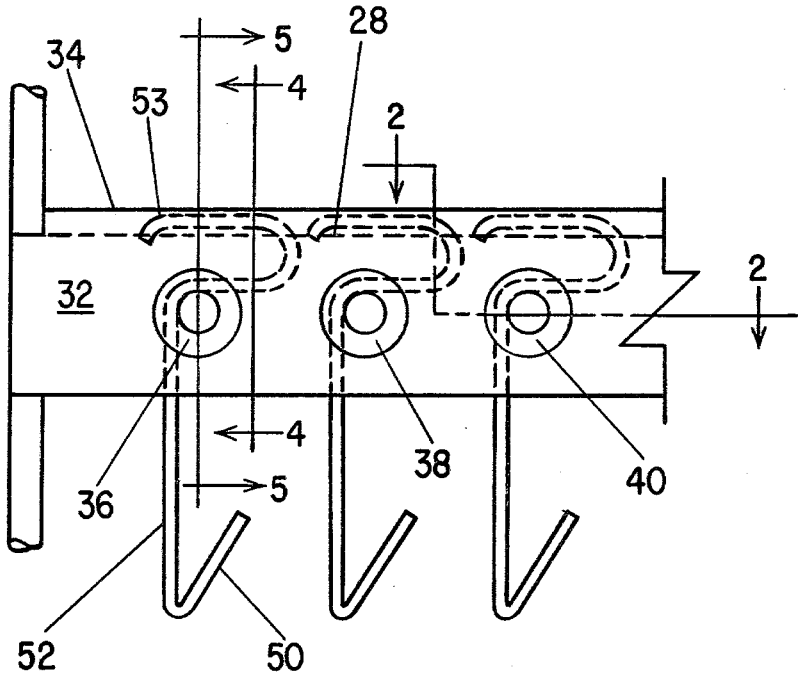
FIG. 3 is a front view of the portion of the preferred embodiment illustrated in FIG. 1.
Figure 4:
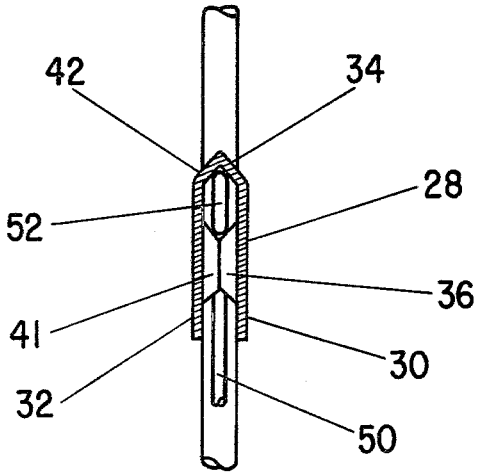
FIG. 4 is a view in vertical section taken along the line 4—4 of FIG. 3.
Figure 5:
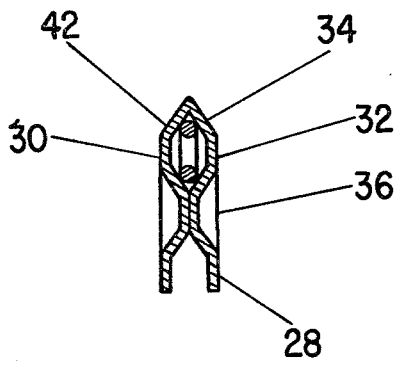
FIG. 5 is a view in vertical section taken along the line 5—5 of FIG. 3.

Each of the support hooks has a workpiece engaging portion 50 and a crossbar engaging portion 52 as illustrated in FIG. 3.

The workpiece engaging portion of each support hook is customarily in a hook shape but also may be in any other configuration suitable for engaging and supporting particular workpieces. Often this portion is custom designed to accomodate particular problems with particular workpieces. It may, for example, extend laterally of the support rack or it may extend forwardly to hold the workpieces out and away from the rack.

The crossbar engaging portion of each support hook extends upwardly between the panels or legs of the crossbar and into engagement with and extending partially around a crossbeam. Preferably, each support hook is a metallic rod made of steel bar stock and formed into partially surrounding engagement with a crossbeam. Thereafter, the rod is bent around to extend into engagement against the cross web 34.

The crossbar engaging portion 52 of each hook is resiliently flexible so that it may be compressed for insertion between its associated crossbeam and the cross web and then released to apply oppositely directed resilient forces against the cross web and the crossbeam. These resilient forces releasably retain the support hooks in the crossbar.

Figure 9:
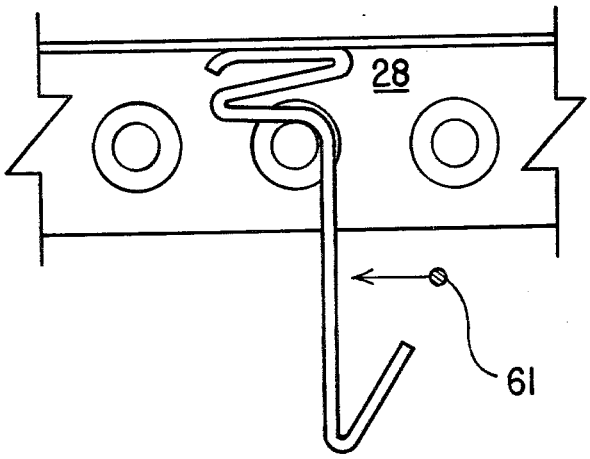
FIG. 9 is a front view of a segment of a support rack illustrating an alternative structural formation of the rack-engaging portion of a support hook embodying the present invention.

Preferably, the hook extends between the crossbar and cross web so that it engages the cross web in at least two places which are spaced apart on laterally opposite sides of the crossbeam. This prevents the accidental pivoting of the support hooks about the crossbeams which would allow them to fall out of the rack. Preferably, the support hook extends linearly along the inner surface of the cross web as illustrated in FIG. 3 and has a backturn 53 to facilitate insertion and removal. There are a variety of alternative ways of forming the rack engaging portion of the support hooks. For example, FIG. 9 illustrates a support hook which is preferred when the steel stock is of sufficiently small diameter to permit the necessary bending. It has a rack-engaging portion which is bent into an extra loop to increase its resilience and ease its removal using a tool.

Figure 6:
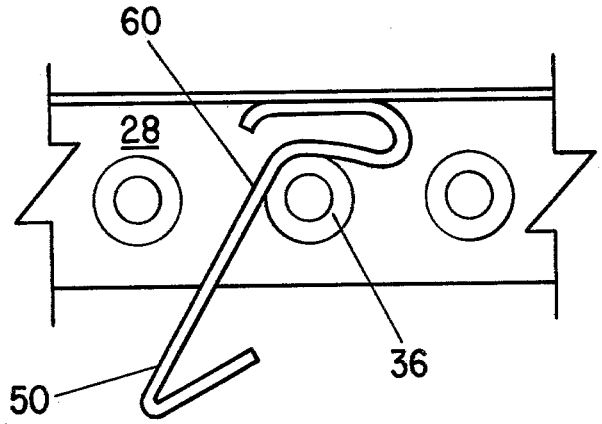
FIG. 6 and FIG. 7 are diagrammatic views illustrating the removal and insertion of the support hooks into the main frame of the painting support rack embodying the present invention.
Figure 7:
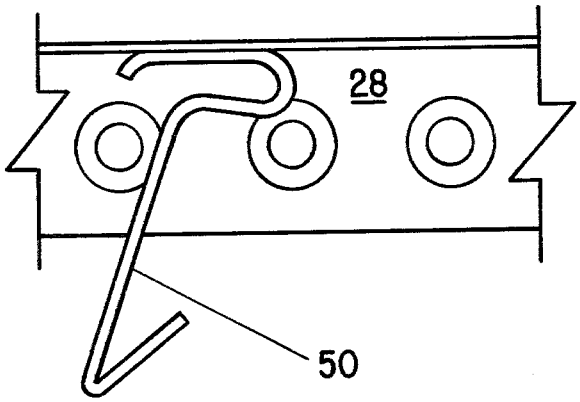
Figure 8:
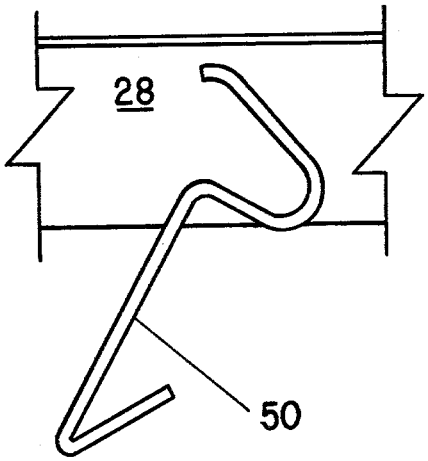
FIG. 8 is a front view of an example of one type of support hook embodying the present invention which is removed from the main frame of the rack and relaxed.

FIGS. 6 and 7 are diagrams illustrating the ease and quickness with which hooks may be removed from the main frame of the painting support rack embodying the present invention. Referring to FIG. 6, the workpiece engaging portion 50 of the support hook is grasped, pivoted and either lifted upwardly to raise the bend 60 above the crossbeam 36 or merely pivoted in a counterclockwise direction. The entire support hook is then slid to the left as illustrated in FIG. 7 and lowered out of the crossbeam 28. Hooks are replaced in the opposite sequence. FIG. 8 shows a relaxed support hook. The preferred hooks constructed as shown in FIG. 9 are easily removed by moving a bar or a tool 61 longitudinally along the crossbar in the direction indicated in FIG. 9 to pivot the hooks out of their clamped engagement in the crossbar.

From the above description it can be seen that a single-piece crossbar is formed which not only completely shields the electrical contact between the support hooks and both the crossbeam and cross web portions of the crossbar, but also provides rigid support for the entire support rack. The shielding crossbeams are not removable because the shield need not be removed to remove the support hooks and consequently a significant manipulative step is avoided. The hooks are directly releasable with a minimum of manual manipulation and movement. But, during use they are held rigidly in place under spring tension.

The simplicity with which the hooks may be removed and replaced represents a significant labor savings. Because the structure is simplier, its cost of manufacture is low and because the shield serves two functions, both shielding and structural weight supporting, less metal is used, fewer parts are needed and therefore fewer parts are needed to be assembled during manufacture.

Because each hook is centered by the grooves formed in the crossbeams and in the cross web into which the hooks seat, the hooks are centered within the crossbar and do not contact it. The hooks are equally spaced from the interior surfaces of the shielding crossbar. The equal spacing provides equally small gaps past which little or no paint will pass into the interior of the crossbars.

The groove and hook structure further permits the hooks to be constructed from a wide range of wire diameters and still seat rigidly but removably in the center of the grooves. This allows a wire size to be custom selected for the size and weight of each particular workpiece.

I claim:

1. A support rack of the type having a main frame and removable workpiece support hooks on which workpieces are hung for transporting the workpieces past a coating station, said rack comprising:
   (a) a shielding crossbar having opposed, spaced panels, a cross web extending between and longitudinally along said panels and a crossbeam extending between said panels and spaced from said cross web; and
   (b) a support hook having a workpiece engaging portion and a crossbar engaging portion which extends between said panels into engagement with and extending partially around said crossbeam and further extending into engagement against said cross web, said crossbar engaging portion being resiliently flexible and applying oppositely directed resilient forces against said cross web and against said crossbeam for releasably retaining said hook in said crossbar in electrically conductive contact with said crossbar.

2. A support rack in accordance with claim 1 wherein said crossbar is permanently welded into said rack to form a part of said main frame.

3. An electrically conductive support rack of the type having a conductive main frame and removable conductive workpiece support hooks in electrical contact therewith and upon which are hung workpieces, for transporting the workpieces past an electrostatic coating station, said rack in an operable position comprising:
   (a) a shielding crossbar formed of a horizontal downwardly opening chamber member having opposed spaced panels, a cross web extending between and longitudinally along said panels, and a plurality of crossbeams extending between the panels of said channel member, said crossbeams being spaced from each other, arranged along said channel member and spaced from the cross web of said channel member; and
   (b) a plurality of support hooks, each of said support hooks having a workpiece engaging portion and a crossbar engaging portion extending into said channel member into engagement with and extending partially around a different one of said crossbeams between its engaged crossbeam and said cross web and further extending into engagement against said cross web, said crossbar engaging portion being resiliently flexible and applying oppositely directed resilient forces against said cross web and its engaged crossbeam for releasably retaining said hooks in electrically conductive contact with said crossbar.

4. A support rack in accordance with claim 3 wherein said rack further comprises:
   (a) a pair of generally vertical side bars;
   (b) a plurality of said crossbars welded to said side bars; and
   (c) said support hooks each formed of a bent metallic rod.

5. A support rack in accordance with claim 3 wherein said support hooks are bent into engagement with said crossbeams and thereafter loop around into engagement with said cross web in at least two places which are spaced on laterally opposite sides of said crossbeams.

6. A support rack in accordance with claim 5 wherein each of said support hooks loop away from said crossbeams and extend linearly along the inner surface of said cross web.

7. A support rack in accordance with claim 5 wherein each of said crossbeams is formed from opposite, inwardly tapering projections on the panels of said channel member, said projections being connected together to form an annular bevelled groove in said crossbeam and wherein the cross web of said channel member tapers outwardly to form an interior bevelled groove whereby said support hooks are centered in engagement with the bevelled grooves of said crossbeams and said cross web.

8. A support rack in accordance with claim 7 wherein said crossbeams are formed by opposite, inwardly extending frusto-conical bosses embossed on the opposite legs of said crossbeams and attached together.

9. A support rack in accordance with claim 8 wherein said rack further comprises:
   (a) a pair of generally vertical side bars;
   (b) a plurality of said crossbars welded to said side bars; and
   (c) said support hooks each comprise a bent metallic rod.

10. A support rack in accordance with claim 9 wherein each said support hooks loop away from said crossbeams and extend linearly along said interior bevelled groove.

* * * * *